US008025510B2

(12) United States Patent
Bolshakov et al.

(10) Patent No.: US 8,025,510 B2
(45) Date of Patent: Sep. 27, 2011

(54) TETHERED PORT PROTECTOR FOR PORTABLE ELECTRONIC DEVICES AND KIT OF PORT PROTECTORS

(76) Inventors: Mikhail Bolshakov, Jupiter, FL (US); Saminda Ranaweera, Stuart, FL (US); Ivan Bolshakov, Jupiter, FL (US)

( * ) Notice: Subject to any disclaimer, the term of this patent is extended or adjusted under 35 U.S.C. 154(b) by 0 days.

(21) Appl. No.: 12/711,813

(22) Filed: Feb. 24, 2010

(65) Prior Publication Data

US 2011/0207349 A1 Aug. 25, 2011

(51) Int. Cl.
*H01R 13/44* (2006.01)

(52) U.S. Cl. ..... 439/136; 439/521

(58) Field of Classification Search ..... 439/136, 439/521

See application file for complete search history.

(56) References Cited

U.S. PATENT DOCUMENTS

| | | | | |
|---|---|---|---|---|
| 2,021,787 | A * | 11/1935 | Janowitz | 16/407 |
| 3,926,399 | A * | 12/1975 | Tendler | 248/467 |
| 4,101,032 | A * | 7/1978 | Obidniak | 206/457 |
| 5,232,287 | A * | 8/1993 | Roy | 383/6 |
| D355,892 | S | 2/1995 | Pyzik | |
| 5,547,388 | A | 8/1996 | Hill | |
| 6,113,267 | A * | 9/2000 | Roy | 383/13 |
| 6,141,667 | A * | 10/2000 | Duff | 708/100 |
| 6,212,741 | B1 * | 4/2001 | Cahill | 24/298 |
| 6,406,321 | B1 | 6/2002 | Hayashi et al. | |
| 7,048,556 | B2 | 5/2006 | Stanton et al. | |
| 7,189,084 | B2 | 3/2007 | Iikura | |
| 7,416,424 | B1 * | 8/2008 | Deckman | 439/135 |
| 7,500,866 | B2 * | 3/2009 | Gennai et al. | 439/367 |
| 7,563,113 | B2 * | 7/2009 | Sheng | 439/135 |
| D602,442 | S | 10/2009 | Allwood | |
| 2002/0119697 | A1 | 8/2002 | Chan | |
| 2004/0258336 | A1 * | 12/2004 | Hou | 384/276 |
| 2005/0072892 | A1 * | 4/2005 | Fell | 248/441.1 |
| 2008/0268706 | A1 * | 10/2008 | Sheng | 439/587 |
| 2009/0163058 | A1 | 6/2009 | Craig et al. | |
| 2009/0262489 | A1 | 10/2009 | Lin et al. | |

* cited by examiner

*Primary Examiner* — James Harvey

(74) *Attorney, Agent, or Firm* — Laurence A. Greenberg; Werner H. Stemer; Ralph E. Locher

(57) ABSTRACT

A port protector for an electronic device that is formed with one or more ports having an access opening. The port protector includes a protective plug having a shape substantially corresponding to a shape of the access opening of the port of the electronic device and being configured to seal the opening of the port when the plug is inserted into the opening. An elastic tether strip has a first end connected to and integrally formed with at least a part of the protective plug. An attachment tab is integrally formed at a second end of said tether strip, opposite and distally from the protective plug. The attachment tab is configured for removable attachment to the surface of the shell body of the electronic device. The tether strip has a length enabling the protective plug to be inserted into and removed from the opening of the port while the attachment tab is attached to the surface of the shell body of the electronic device.

7 Claims, 2 Drawing Sheets

TETHERED PORT PROTECTOR FOR PORTABLE ELECTRONIC DEVICES AND KIT OF PORT PROTECTORS

BACKGROUND OF THE INVENTION

Field of the Invention

The invention relates to jack and port protectors for electronic devices and, in particular, to portable and mobile devices such as cell phones, smart phones, PDAs, and the like.

Portable devices typically have several ports or other access openings. These include terminal ports for battery chargers, ports for headphones, docking ports, communication connector ports, and camera lens openings, to name just a few. In many environments, such as in construction, these ports are often subjected to soiling by dust or similarly unwanted material.

Users have the option of carrying the device in a protective pouch, which render operation of the device cumbersome or impossible, or the device may be partially protected. Partial protection is afforded, for example, by plug protectors, typically of a soft rubber or silicone material. When it is necessary to use the port, the plug is temporarily removed from the port. In many cases, these plug protectors are permanently tethered to the device. The prior art knows of tethered protectors for mobile device ports with a tether that must be installed by screwing or unscrewing a portion of the device to insert and secure the tether. Such a system is described, for example, in U.S. Pat. No. 7,048,556. There, there is disclosed a connector cover with a squeeze release, albeit not for a port of a mobile device.

There exist numerous additional U.S. patents and published applications, that are pertinent. For example, U.S. Patent Application Publication No. 2002/0119697 describes a mobile phone connector with anti-dust and water resistant functions. U.S. Patent Application Publication No. 2009/0262489 discloses an electronic device with a covering lid for covering insert hole. U.S. Pat. No. 7,500,866 describes a "lid" for a communications terminal. U.S. Pat. No. 7,189,084 discloses a connector cover for a portable terminal. U.S. Pat. No. 7,048,556 discloses a connector cover for a communication device. U.S. Pat. No. 6,406,321 discloses an auxiliary structure for connecting a connector for use in portable telephones. U.S. Pat. No. 5,547,388 discloses a connector cover having a squeeze release.

Tethered port protectors known from the prior art are permanently connected and they cannot be exchanged and replaced by the user, for example, when the protector plug becomes unusable or the tether tab breaks.

Reference may also be had, for example, to tethered dust covers for camera lenses. However, such "lens cap keepers" are not integral with a dust cover, nor are they tethered in the manner suggested herein.

A multiplicity of non-tethered jack/port protectors are commercially available for various devices, such as the iPhone, iPod, PSP, Palm Pre, and other mobile devices. However, these protectors do not include a tab tethering the protector to the device.

BRIEF SUMMARY OF THE INVENTION

It is accordingly an object of the invention to provide a tethered port protector for portable electronic devices which overcomes the above-mentioned disadvantages of the heretofore-known devices and methods of this general type and which provides for a tethered plug that can be easily replaced by a user of the device, should the need arise.

With the foregoing and other objects in view there is provided, in accordance with the invention, a port protector for an electronic device, the electronic device having a port with an access opening and a shell body with a surface. The port protector comprises:

a protective plug having a shape substantially corresponding to a shape of the port of the electronic device and being configured to seal an opening of the port when said plug is inserted into the opening of the port;

an elastic tether strip having a first end connected to and integrally formed with at least a part of said protective plug; and an attachment tab integrally formed with a second end of said tether strip, opposite and distally from said protective plug, said attachment tab being configured for removable attachment to the surface of the shell body of the electronic device, and said tether strip having a length enabling said protective plug to be inserted into and removed from the opening of the port while said attachment tab is attached to the surface of the shell body of the electronic device.

In other words, the invention provides for a jack or port protector that is tethered to the device by a removable tab.

The expression "permanently connected" is juxtaposed against the expression "removably connected" as relative terms. Here, permanent means that a connection is formed that requires tools, or at least considerable disassembly and assembly effort, for the removal of the tab. Removable, on the other hand, means that a typical user of the device is able to install and remove the tab without complicated disassembly and reassembly, and without tools (except a peeling blade, in certain circumstances).

In accordance with an added feature of the invention, the protective plug is formed of a soft-elastic material, such as rubber or silicone.

In accordance with an additional feature of the invention, an amount of adhesive material disposed on said attachment tab, for non-permanently gluing said attachment tab to the surface of the shell body of the electronic device.

In accordance with another feature of the invention, the attachment tab is formed of a material enabling said tab to cling to the surface of the shell body of the electronic device by static charge.

In accordance with a concomitant feature of the invention, there is provided a hook-and-loop patch on the surface of the shell body of the electronic device, and a corresponding hook-and-loop patch disposed on said attachment tab.

With the above and other objects in view, there is also provided, in accordance with the invention, an accessory kit for an electronic device, the electronic device having a shell body with a surface and a plurality of ports each with an access opening, the kit comprising:

a plurality of port protectors respectively configured to protect each of the plurality of ports of the electronic device, each of said port protectors including:

protective plug having a shape substantially corresponding to a shape of the access opening of the port of the electronic device and being configured to seal the access opening of the port when said plug is inserted into the access opening;

an elastic tether strip having a first end connected to and integrally formed with said protective plug; and an attachment tab integrally formed with a second end of said tether strip, opposite and distally from said protective plug, said attachment tab being configured for removable attachment to the surface of the shell body of the electronic device, and said tether strip having a length enabling said protective plug to be inserted into and removed from the access opening of the port while said attachment tab is attached to the surface of the shell body of the electronic device.

Other features which are considered as characteristic for the invention are set forth in the appended claims.

Although the invention is illustrated and described herein as embodied in a tethered port protector for portable electronic devices, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DETAILED DESCRIPTION OF THE INVENTION

Figure 1:
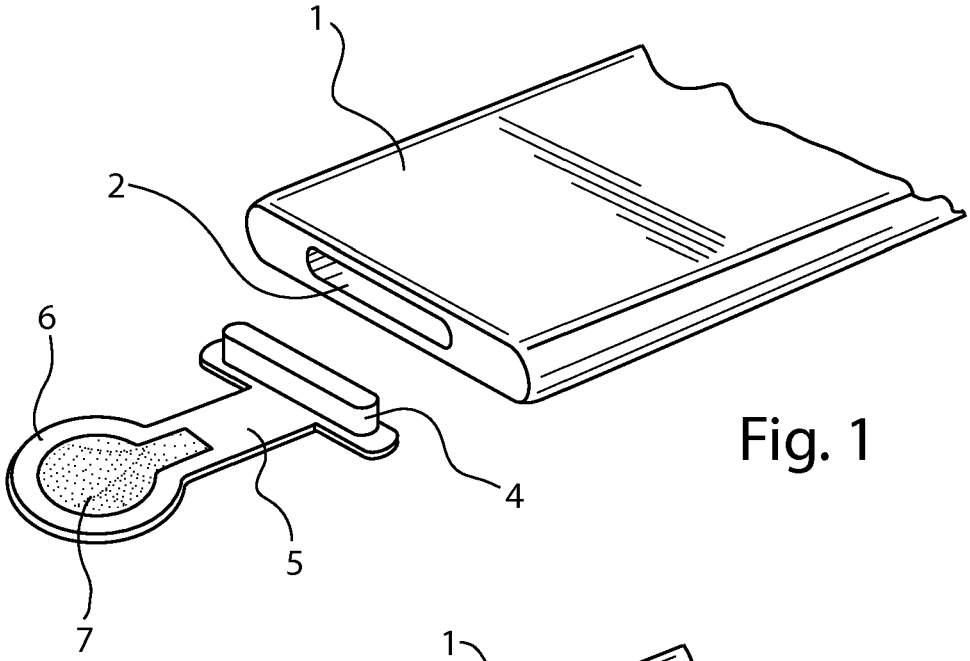
FIG. 1 is a perspective partial view of an electronic device and an exemplary port protector according to the invention.

Referring now to the figures of the drawing in detail and first, particularly, to FIG. 1 thereof, there is seen an electronic device 1—a bottom portion of an Apple® iPhone®—with its charging and docking port 2. The port 2 is formed by a recess in the shell of the device and it houses a multiplicity of electrical contacts. The shell has at least one smooth surface, here the entire back of the device. The shell of the electronic device 1 hermetically seals the device in its entirety, except for the few port openings that are required for direct-contact electrical connections. It is important for the proper functionality of the port 2, here for charging and data communication, that the electrical contacts remain free of dust and other foreign matter. The port 2 can thus be closed and sealed with a port protector 3 according to the invention.

The port protector 3 includes a plug 4, which is matched to the shape of the port 2. Here, the plug is formed with a substantially rectangular, brick-shaped protrusion that fits snugly into the port 2. In addition, it is formed with a lip that comes to lie against the surrounding shell body of the electronic device 1 when the plug 4 is inserted into the port 2. The sealing function, accordingly, is two-fold, namely, by the snug insertion of the brick-shaped protrusion into the recess of the port 2 and the surrounding lip seal of the plug 4. The width of the lip depends on the available surface structure surrounding the recess of the port 2. The lip should not project beyond the surrounding surface, because it would be jarred loose too easily.

The plug 4 is formed of relatively soft, elastic material. Preferably, it is formed of silicone, rubber, or any rubber-like material.

Figure 2:
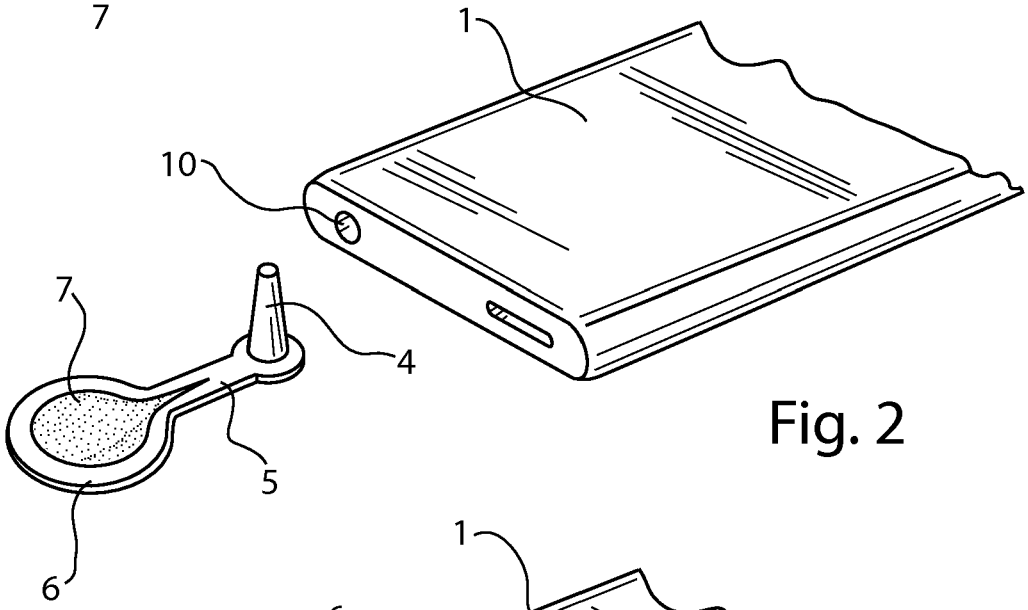
FIG. 2 is a perspective view, showing the opposite end of the electronic device, with a further exemplary port protector.

FIG. 2 shows the opposite end of the electronic device, with a headphone jack protector plug 4. Here, the plug 4 is form conically, so that, on insertion into the opening 10, it seals against the walls and the entrance lip of the jack opening 10.

The plug 4 is integrally connected by way of a tether strip 5 to an attachment pad or tab 6. The tab 6 is provided with a glue surface 7 by way of which it can be attached to the shell body of the electronic device 1. A variety of attachment possibilities are available. For example, the glue surface 7 may be provided with a thin layer of adhesive, similar to adhesive tape. Care should be taken, in this context, to provide an adhesive compound that will have superior adhesion to the pad 6 and inferior adhesion to the shell body of the electronic device 1. Otherwise, adhesive will remain on the shell body when the tab 6 is removed, for instance, when the port protector 3 is to be replaced or temporarily removed.

It is also possible to attach the tab 6 without a layer of adhesive compound, namely, by way of static cling that is effected by a static electric charge. That is, the tab 6 may be formed of a material that lends itself to keeping static charges, similar to Saran (polymers made from polyvinylidene chloride) or the like.

Figure 4:
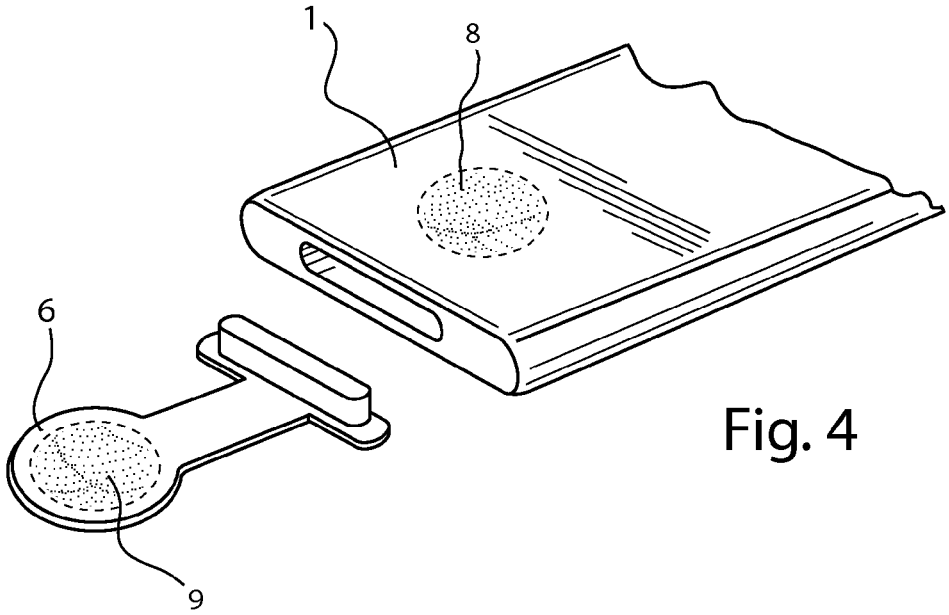
FIG. 4 is a similar perspective view of an alternative embodiment of the invention.

In accordance with yet a further alternative, it is also possible to use hook-and-loop (Velcro®) type fastener for attaching the tab 6 to the electronic device 1. This alternative, which is illustrated in FIG. 4, is particularly suitable for very dirty environments, such as in heavy construction. Here, the shell surface of the electronic device carries a "permanently attached" hook or loop patch 8 and the tab 6 carries a corresponding loop or hook patch 9. The patch 8 is glued to the shell surface and it cannot be easily removed by simple pulling. It can, however, be removed by peeling with a peel blade, such as a razor blade, or the like.

Figure 5A:
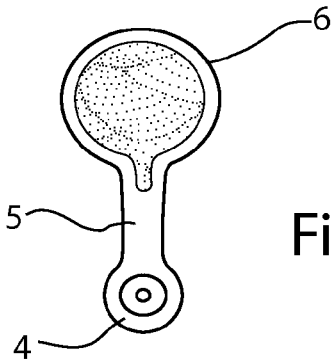
FIGS. 5A-5D are plan views onto the tether and attachment tab in a variety of exemplary designs.
Figure 5B:
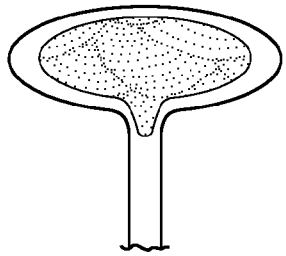
Figure 5C:
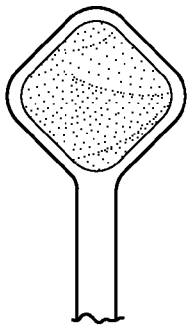
Figure 5D:
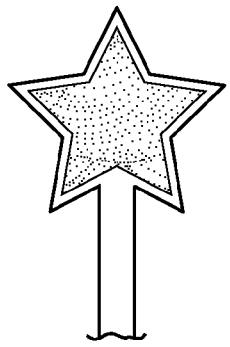

With reference to FIGS. 5A-5D, the tab 6 may take any of a number of shapes. For example, the tab 6 may be circular round, as shown in FIG. 5A. The round tab 6 merges smoothly into the tether strip 5, which merges smoothly into the base of the plug 4. Alternatively, the tab 6 may be oval, as shown in FIG. 5B, it may be diamond-shaped, as shown in FIG. 5C, or it may be star-shaped, as shown in FIG. 5D. It will be understood that any other shape is functionally possible, as long as the outline of the tab surface does not exceed the measurements of the underlying surface of the electronic device 1 to which the plug protector 3 is to be connected.

The tab 6, the tether strip 5, and the plug 4 are integrally formed in one piece. That is to say, the base elements of the tab, the strip, and the plug are integrally formed. It is understood, of course, that the plug 4 itself, i.e., the protruding structure, may be formed separately and then attached to the base wall. Also, the adhesive 7 or the pad 9 are additional materials. It is thus possible to stamp the base elements from a sheet of material by way of a stamp, much like a cookie cutter, or to cut them from a sheet by way of a laser cutting or chemical jet cutting process. The plug structure (i.e., the projecting hole-sealing plug) can then be adhered to the flat sheet. It is, or course, also possible to attach the plug structure first on a sheet and then dice the individual port protectors 3 from the sheet of material.

The tab 6 and the tether strip 5 are preferably formed from a material that is no more than approximately 1 mm or 4 mils (0.04 inches) thick. Preferred thicknesses lie in the range of 0.6 mm and most preferably less than 0.5 mm, that is, less than about 3 mils (1 mil=$1000^{th}$ inch), 2.5 mils, and about 2 mils or less.

Figure 3:
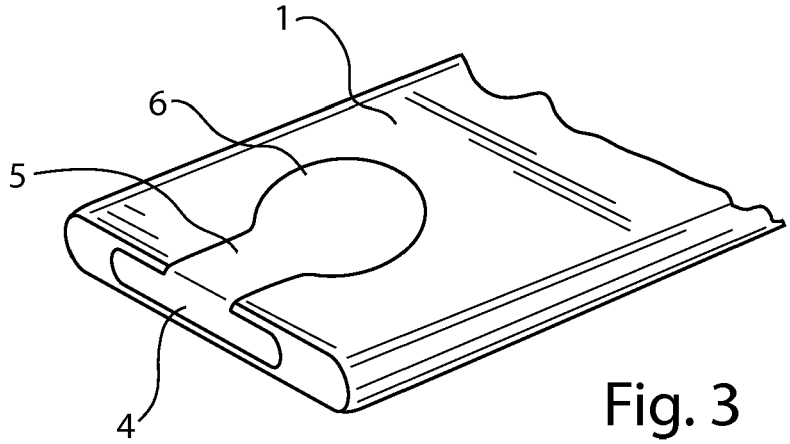
FIG. 3 is a perspective view, similar to FIG. 1, showing the port protector mounted and attached to the electronic device.

According to the invention, there is provided a kit with a variety of port protectors. In the context of the iPhone®, for example, the kit includes at least a port protector for the docking port, as shown in FIGS. 1 and 3, and a port protector for the earphone plug 10, as shown in FIG. 2. In a preferred embodiment, there are provided a plurality of such protectors so that they may be exchanged sporadically. Further, it is also envisioned here to provide a collection kit, which would include corresponding port protectors for an entire set of electronic devices. For example, the collection may include all of the corresponding protectors for an iPhone, an iPod, and an iPad, to name just one exemplary collection.

It will be understood that, while several references have been made to various Apple® products and the invention has been explained with reference to such an electronic device, the invention is not limited to such products.

The invention claimed is:

1. A port protector for an electronic device, the electronic device having a port with an access opening and a shell body with a surface, the port protector comprising:

a protective plug having a shape substantially corresponding to a shape of the port of the electronic device and being configured to seal an opening of the port when said plug is inserted into the opening of the port;

an elastic tether strip having a first end connected to and integrally formed with at least a part of said protective plug; and an attachment tab integrally formed with a second end of said elastic tether strip, opposite and distally from said protective plug, said attachment tab being configured for readily removable attachment to the surface of the shell body of the electronic device, and said tether strip having a length and elasticity enabling said protective plug to be inserted into and removed from the opening of the port while said attachment tab is attached to the surface of the shell body of the electronic device, and wherein said attachment tab is removably connected to the surface of the electronic device solely by way of a connection selected from the group consisting of a glue connection, a static charge cling connection, and a hook-and-loop connection, and substantially without forming a permanent connection.

2. The port protector according to claim 1, wherein said protective plug is formed of a soft-elastic material.

3. The port protector according to claim 2, wherein said soft-elastic material is rubber or silicone.

4. The port protector according to claim 1, which comprises an amount of adhesive material disposed on said attachment tab, for non-permanently gluing said attachment tab to the surface of the shell body of the electronic device.

5. The port protector according to claim 1, wherein said attachment tab is formed of a material enabling said tab to cling to the surface of the shell body of the electronic device by static charge.

6. The port protector according to claim 1, which comprises a hook-and-loop patch on the surface of the shell body of the electronic device, and a corresponding hook-and-loop patch disposed on said attachment tab.

7. An accessory kit for an electronic device, the electronic device having a shell body with a surface and a plurality of ports each with an access opening, the kit comprising:

a plurality of port protectors respectively configured to protect each of the plurality of ports of the electronic device, each of said port protectors including:

protective plug having a shape substantially corresponding to a shape of the access opening of the port of the electronic device and being configured to seal the access opening of the port when said plug is inserted into the access opening;

an elastic tether strip having a first end connected to and integrally formed with said protective plug; and an attachment tab integrally formed with a second end of said elastic tether strip, opposite and distally from said protective plug, said attachment tab being configured for readily removable attachment to the surface of the shell body of the electronic device, and said tether strip having a length and elasticity enabling said protective plug to be inserted into and removed from the access opening of the port while said attachment tab is attached to the surface of the shell body of the electronic device, and wherein said attachment tab is removably connected to the surface of the electronic device solely by way of a connection selected from the group consisting of a glue connection, a static charge cling connection, and a hook-and-loop connection, and substantially without forming a permanent connection.

* * * * *